US009405239B2

(12) United States Patent
Ikebuchi et al.

(10) Patent No.: US 9,405,239 B2
(45) Date of Patent: Aug. 2, 2016

(54) FIXING DEVICE, IMAGE FORMING APPARATUS, AND FIXING METHOD

(71) Applicants: Yutaka Ikebuchi, Kanagawa (JP); Takayuki Seki, Kanagawa (JP); Yuji Arai, Kanagawa (JP); Yoshiki Yamaguchi, Kanagawa (JP); Shuntaroh Tamaki, Kanagawa (JP); Kazuya Saito, Kanagawa (JP)

(72) Inventors: Yutaka Ikebuchi, Kanagawa (JP); Takayuki Seki, Kanagawa (JP); Yuji Arai, Kanagawa (JP); Yoshiki Yamaguchi, Kanagawa (JP); Shuntaroh Tamaki, Kanagawa (JP); Kazuya Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/010,823

(22) Filed: Aug. 27, 2013

(65) Prior Publication Data

US 2014/0079424 A1 Mar. 20, 2014

(30) Foreign Application Priority Data

Sep. 14, 2012 (JP) ..... 2012-203268
Apr. 25, 2013 (JP) ..... 2013-092560

(51) Int. Cl.
*G03G 15/20* (2006.01)

(52) U.S. Cl.
CPC ..... *G03G 15/2039* (2013.01); *G03G 15/2042* (2013.01); *G03G 15/2053* (2013.01); *G03G 2215/2035* (2013.01)

(58) Field of Classification Search
None
See application file for complete search history.

(56) References Cited

U.S. PATENT DOCUMENTS 7,925,177 B2 * 4/2011 Ishii ..... G03G 15/2053 399/67
9,046,838 B2 * 6/2015 Arai ..... G03G 15/20
2006/0086730 A1 * 4/2006 Kondo et al. ..... 219/645
2008/0038011 A1 * 2/2008 Nakajima et al. ..... 399/100
2008/0050155 A1 * 2/2008 Miki et al. ..... 399/328
2010/0067929 A1 * 3/2010 Seki ..... G03G 15/2042 399/45
2012/0057909 A1 * 3/2012 Gon ..... G03G 15/2053 399/329
2013/0183072 A1 7/2013 Hase et al.
2013/0209147 A1 8/2013 Ogawa et al.

(Continued)

FOREIGN PATENT DOCUMENTS

CN 1573607 A 2/2005
CN 101673078 A 3/2010

(Continued)

OTHER PUBLICATIONS

English machine translation of Yamamoto (JP2009258203A), published Nov. 5 2009; "Fixing Device and Image Forming Apparatus"; by Yamamoto, Koji.*

(Continued)

*Primary Examiner* — David Gray
*Assistant Examiner* — Geoffrey Evans
(74) *Attorney, Agent, or Firm* — Oblon, McClelland, Maier & Neustadt, L.L.P

(57) ABSTRACT

A fixing device includes a fixing rotary body, a heat shield movably disposed opposite the fixing rotary body, an opposed body contacting the fixing rotary body to form a nip therebetween through which a recording medium is conveyed, and a temperature detector to detect a temperature of at least one of the fixing rotary body and the opposed body. A controller, operatively connected to the heat shield and the temperature detector, determines a rotation angled position to which the heat shield is moved based on a size of the recording medium and the temperature of the at least one of the fixing rotary body and the opposed body detected by the temperature detector.

23 Claims, 8 Drawing Sheets

(56) References Cited

U.S. PATENT DOCUMENTS

| | | | | |
|---|---|---|---|---|
| 2014/0072355 | A1* | 3/2014 | Tamaki | G03G 15/2017 399/329 |
| 2014/0079453 | A1* | 3/2014 | Arai et al. | 399/329 |
| 2014/0079455 | A1* | 3/2014 | Seki et al. | 399/329 |
| 2014/0248072 | A1* | 9/2014 | Yoshinaga | G03G 15/2053 399/329 |
| 2014/0270820 | A1* | 9/2014 | Saito | G03G 15/2039 399/33 |
| 2014/0270831 | A1* | 9/2014 | Yoshinaga | G03G 15/2039 399/67 |
| 2014/0270832 | A1* | 9/2014 | Saito et al. | 399/67 |
| 2014/0270833 | A1* | 9/2014 | Yuasa | G03G 15/2017 399/67 |
| 2014/0270872 | A1* | 9/2014 | Tamaki | G03G 15/2017 399/329 |
| 2014/0341623 | A1* | 11/2014 | Arai | G03G 15/2053 399/329 |
| 2014/0341624 | A1* | 11/2014 | Arai | G03G 15/2053 399/329 |
| 2014/0341625 | A1* | 11/2014 | Imada | G03G 15/2017 399/329 |
| 2014/0341627 | A1* | 11/2014 | Yoshikawa | G03G 15/2053 399/329 |
| 2016/0033906 | A1* | 2/2016 | Ikebuchi | G03G 15/2017 399/329 |
| 2016/0054690 | A1* | 2/2016 | Eiki | G03G 15/2085 399/329 |

FOREIGN PATENT DOCUMENTS

| | | |
|---|---|---|
| CN | 102193438 A | 9/2011 |
| JP | 2004-264785 | 9/2004 |
| JP | 2006-195408 | 7/2006 |
| JP | 2008-058833 | 3/2008 |
| JP | 2008-139779 | 6/2008 |
| JP | 2009-258203 | 11/2009 |
| JP | 2012-118225 | 6/2012 |
| JP | 2013-164430 | 8/2013 |
| JP | 2013-164440 | 8/2013 |
| JP | 2013-164473 | 8/2013 |

OTHER PUBLICATIONS

Combined Chinese Office Action and Search Report issued Jun. 2, 2015 in Patent Application No. 201310406524.6 (with English translation of categories of cited documents).

Japanese Office Action issued Dec. 1, 2014, in Japan Patent Application No. 2013-092560.

U.S. Appl. No. 14/024,931, filed Sep. 12, 2013.

U.S. Appl. No. 14/014,653, filed Aug. 30, 2013.

U.S. Appl. No. 14/015,035, filed Aug. 30, 2013.

* cited by examiner

FIXING DEVICE, IMAGE FORMING APPARATUS, AND FIXING METHOD

CROSS-REFERENCE TO RELATED APPLICATIONS

This patent application is based on and claims priority pursuant to 35 U.S.C. §119 to Japanese Patent Application Nos. 2012-203268, filed on Sep. 14, 2012, and 2013-092560, filed on Apr. 25, 2013, in the Japanese Patent Office, the entire disclosure of each of which is hereby incorporated by reference herein.

BACKGROUND

1. Technical Field

Exemplary aspects of the present invention relate to a fixing device, an image forming apparatus, and a fixing method, and more particularly, to a fixing device for fixing an image on a recording medium, an image forming apparatus incorporating the fixing device, and a fixing method for fixing a toner image on a recording medium.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body heated by a heater and an opposed body contacting the fixing rotary body to form a nip therebetween through which a recording medium bearing a toner image is conveyed. As the fixing rotary body and the opposed body rotate and convey the recording medium bearing the toner image through the nip, the fixing rotary body heated to a predetermined fixing temperature and the opposed body together heat and melt toner of the toner image, thus fixing the toner image on the recording medium.

Since the recording medium passing through the nip draws heat from the fixing rotary body, a temperature sensor detects the temperature of the fixing rotary body to maintain the fixing rotary body at a desired temperature. However, at each lateral end of the fixing rotary body in an axial direction thereof, the recording medium is not conveyed over the fixing rotary body and therefore does not draw heat from the fixing rotary body. Accordingly, after a plurality of recording media is conveyed through the nip continuously, a non-conveyance span situated at each lateral end of the fixing rotary body may overheat.

To address this circumstance, the fixing device may incorporate a heat shield to shield the non-conveyance span of the fixing rotary body from the heater, thus preventing overheating of the fixing rotary body. For example, the heat shield may be movable between a plurality of positions to correspond to a plurality of non-conveyance spans varying depending on the size of recording media. However, the heat shield is retained at an identical position during a print job for forming a toner image on a plurality of recording media of an identical size. Accordingly, if the temperature of the non-conveyance span of the fixing rotary body increases accidentally during the print job, the heat shield may not be able to prevent the fixing rotary body from overheating.

SUMMARY

This specification describes below an improved fixing device. In one exemplary embodiment, the fixing device includes a fixing rotary body rotatable in a predetermined direction of rotation, a heater disposed opposite and heating the fixing rotary body, an opposed body contacting the fixing rotary body to form a nip therebetween through which a recording medium is conveyed, and a heat shield movably disposed opposite the fixing rotary body. The heat shield includes a noncircular shield portion disposed opposite a lateral end of the fixing rotary body in an axial direction thereof to shield the fixing rotary body from the heater and a recess defined by the shield portion in the axial direction of the fixing rotary body. A temperature detector is disposed opposite at least one of the fixing rotary body and the opposed body to detect a temperature of the at least one of the fixing rotary body and the opposed body. A controller is operatively connected to the heat shield and the temperature detector to determine a rotation angled position to which the heat shield is moved based on a size of the recording medium and the temperature of the at least one of the fixing rotary body and the opposed body detected by the temperature detector.

This specification further describes an improved image forming apparatus. In one exemplary embodiment, the image forming apparatus includes the fixing device described above.

This specification further describes an improved fixing method. In one exemplary embodiment, the fixing method includes placing a heat shield at a retracted position where the heat shield is not interposed between a heater and a fixing rotary body, conveying a recording medium over the fixing rotary body, determining that a temperature of the fixing rotary body is not lower than a predetermined first temperature, moving the heat shield to a first rotation angled position where the heat shield is interposed between the heater and the fixing rotary body to shield the fixing rotary body from the heater, determining that the temperature of the fixing rotary body is not lower than a predetermined second temperature higher than the first temperature, and moving the heat shield to a second rotation angled position where the heat shield is interposed between the heater and the fixing rotary body to shield the fixing rotary body more fully from the heater than at the first rotation angled position.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
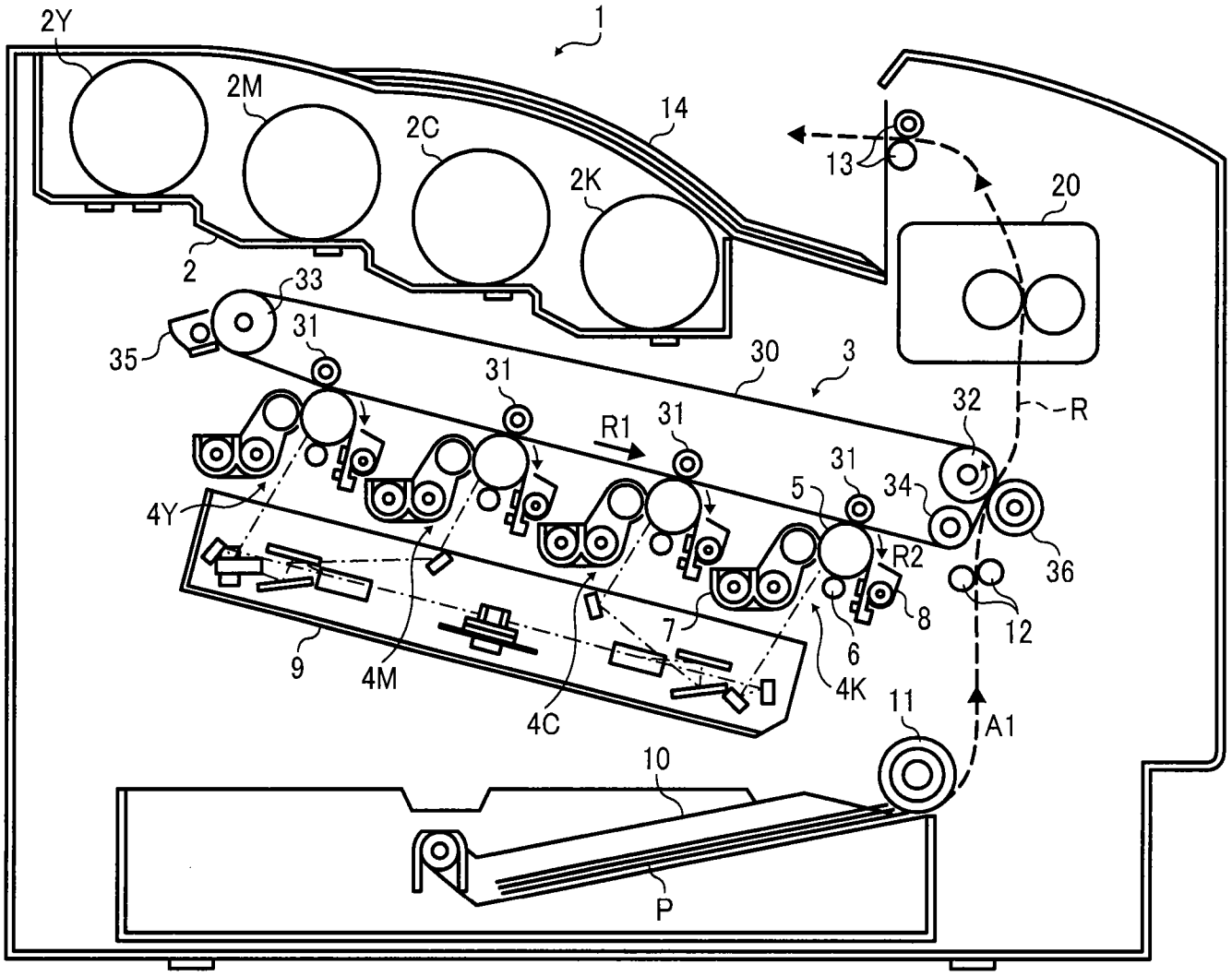
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

As shown in FIG. 1, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, OHP (overhead projector) transparencies, OHP film sheets, and the like. Additionally, a bypass tray that loads postcards, envelopes, OHP transparencies, OHP film sheets, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
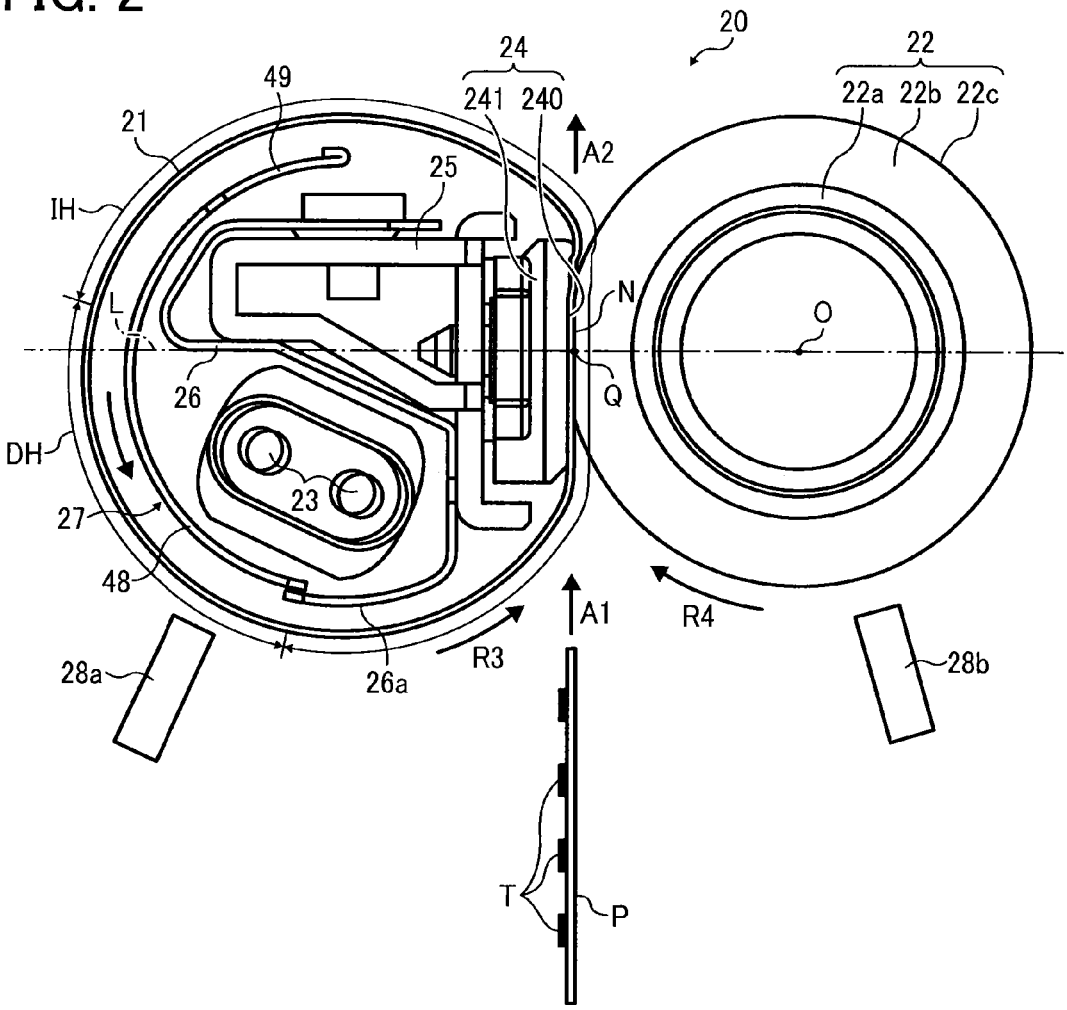
FIG. 2 is a vertical sectional view of a fixing device incorporated in the image forming apparatus shown in FIG. 1 illustrating a heat shield incorporated therein situated at a shield position.
Figure 3:
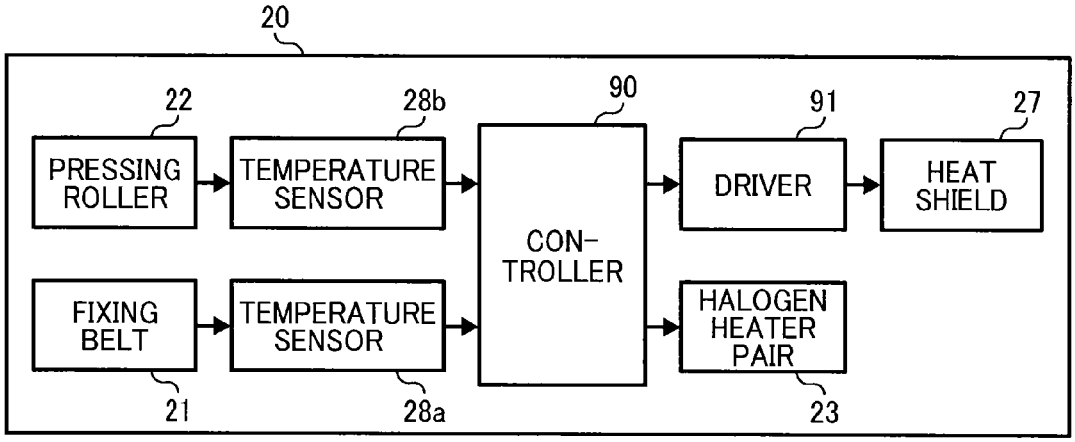
FIG. 3 is a block diagram of the fixing device shown in FIG. 2.

With reference to FIGS. 2 and 3, a description is provided of a construction of the fixing device 20 incorporated in the image forming apparatus 1 described above.

FIG. 2 is a vertical sectional view of the fixing device 20. FIG. 3 is a block diagram of the fixing device 20. As shown in FIG. 2, the fixing device 20 (e.g., a fuser) includes a fixing belt 21 serving as a fixing rotary body or an endless belt formed into a loop and rotatable in a rotation direction R3; a pressing roller 22 serving as an opposed body disposed opposite an outer circumferential surface of the fixing belt 21 and rotatable in a rotation direction R4 counter to the rotation direction R3 of the fixing belt 21; a halogen heater pair 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater pair 23 thereto toward the fixing belt 21; a heat shield 27 interposed between the halogen heater pair 23 and the fixing belt 21 to shield the fixing belt 21 from light radiated from the halogen heater pair 23; a temperature sensor 28*a* serving as a first temperature detector disposed opposite the outer circumferential surface of the fixing belt 21 and detecting the temperature of the fixing belt 21; a temperature sensor 28*b* serving as a second temperature detector disposed opposite an outer circumferential surface of the pressing roller 22 and detecting the temperature of the pressing roller 22; and a controller 90 depicted in FIG. 3 operatively connected to the temperature sensors 28*a* and 28*b* and the heat shield 27 to control the rotation angle of the heat shield 27.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing performance of being heated to a predetermined fixing temperature quickly. However, as the pressing roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 80 micrometers. The elastic layer having the thickness not smaller than about 80 micrometers elastically deforms to absorb slight surface asperities of the fixing belt 21, preventing variation in gloss of the toner image T on the recording medium P.

According to this exemplary embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 80 micrometers to about 300 micrometers; and the release layer having a thickness in a range of from about 3 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. According to this exemplary embodiment, the pressing roller 22 is pressed against the fixing belt 21. Alternatively, the pressing roller 22 may merely contact the fixing belt 21 with no pressure therebetween.

A driver (e.g., a motor) disposed inside the image forming apparatus 1 depicted in FIG. 1 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. Further, the elastic layer 22*b* may be made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21.

The halogen heater pair 23 is situated inside the loop formed by the fixing belt 21 and upstream from the fixing nip N in the recording medium conveyance direction A1. For example, the halogen heater pair 23 is situated lower than and upstream from a hypothetical line L passing through a center Q of the fixing nip N in the recording medium conveyance direction A1 and an axis O of the pressing roller 22 in FIG. 2. The power supply situated inside the image forming apparatus 1 supplies power to the halogen heater pair 23 so that the halogen heater pair 23 heats the fixing belt 21.

As shown in FIG. 3, the controller 90 (e.g., a processor), that is, a central processing unit (CPU) provided with a random-access memory (RAM) and a read-only memory (ROM), for example, operatively connected to the halogen heater pair 23 and the temperature sensor 28*a* controls the halogen heater pair 23 based on the temperature of the fixing belt 21 detected by the temperature sensor 28*a* so as to adjust the temperature of the fixing belt 21 to a desired fixing temperature. The controller 90 is also operatively connected to the temperature sensor 28*b* to control the halogen heater pair 23 based on the temperature of the pressing roller 22 detected by the temperature sensor 28*b*.

As shown in FIG. 2, according to this exemplary embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to the sizes of recording media P available in the image forming apparatus 1. However, it is preferable that one or two halogen heaters are situated inside the loop formed by the fixing belt 21 in view of manufacturing costs and limited space inside the loop formed by the fixing belt 21. Alternatively, instead of the halogen heater pair 23, a resistance heat generator, a carbon heater, or the like may be employed as a heater that heats the fixing belt 21 by radiation heat.

A detailed description is now given of a construction of the nip formation assembly 24.

The nip formation assembly 24 includes a base pad 241 and a slide sheet 240 (e.g., a low-friction sheet) covering an outer surface of the base pad 241. For example, the slide sheet 240 covers an opposed face of the base pad 241 disposed opposite the fixing belt 21. A longitudinal direction of the base pad 241 is parallel to an axial direction of the fixing belt 21 or the pressing roller 22. The base pad 241 receives pressure from the pressing roller 22 to define the shape of the fixing nip N. According to this exemplary embodiment, the fixing nip N is planar in cross-section as shown in FIG. 2. Alternatively, the fixing nip N may be concave with respect to the pressing roller 22 or have other shapes. The slide sheet 240 reduces friction between the base pad 241 and the fixing belt 21 sliding over the base pad 241. Alternatively, the base pad 241 may be made of a low friction material. In this case, the slide sheet 240 is not interposed between the base pad 241 and the fixing belt 21.

The base pad 241 is made of a heat resistant material resistant against temperatures of 200 degrees centigrade or more to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 241 is made of general heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The base pad 241 is mounted on and supported by the stay 25. Accordingly, even if the base pad 241 receives pressure from the pressing roller 22, the base pad 241 is not bent by the pressure and therefore produces a uniform nip width throughout the entire width of the pressing roller 22 in the axial direction thereof. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as LCP, metal, ceramic, or the like.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25. Thus, the reflector 26 facilitates efficient heating of the fixing belt 21, saving energy. For example, the reflector 26 is made of aluminum, stainless steel, or the like. If the reflector 26 includes an aluminum base treated with silver-vapor-deposition to decrease radiation and increase reflectance of light, the reflector 26 heats the fixing belt 21 effectively. An opposed face of the reflector 26 disposed opposite the halogen heater pair 23 spans in a circumferential direction of the fixing belt 21 over the inner circumferential surface of the fixing belt 21. The reflector 26 includes lateral end portions **26*a* disposed opposite a lower face of the halogen heater pair 23 in FIG. 2 and in proximity to the inner circumferential surface of the fixing belt 21. The lateral end portions 26*a* are curved along the inner circumferential surface of the fixing belt 21 in the circumferential direction thereof. The lateral end portions 26*a* are disposed opposite lateral ends of the halogen heater pair 23 in a longitudinal direction thereof parallel to the axial direction of the fixing belt 21 to shield the fixing belt 21 from light radiated from the halogen heater pair 23. That is, the lateral end portions 26*a* do not extend throughout the entire width of the reflector 26 in a longitudinal direction thereof parallel to the axial direction of the fixing belt 21**.

Figure 4:
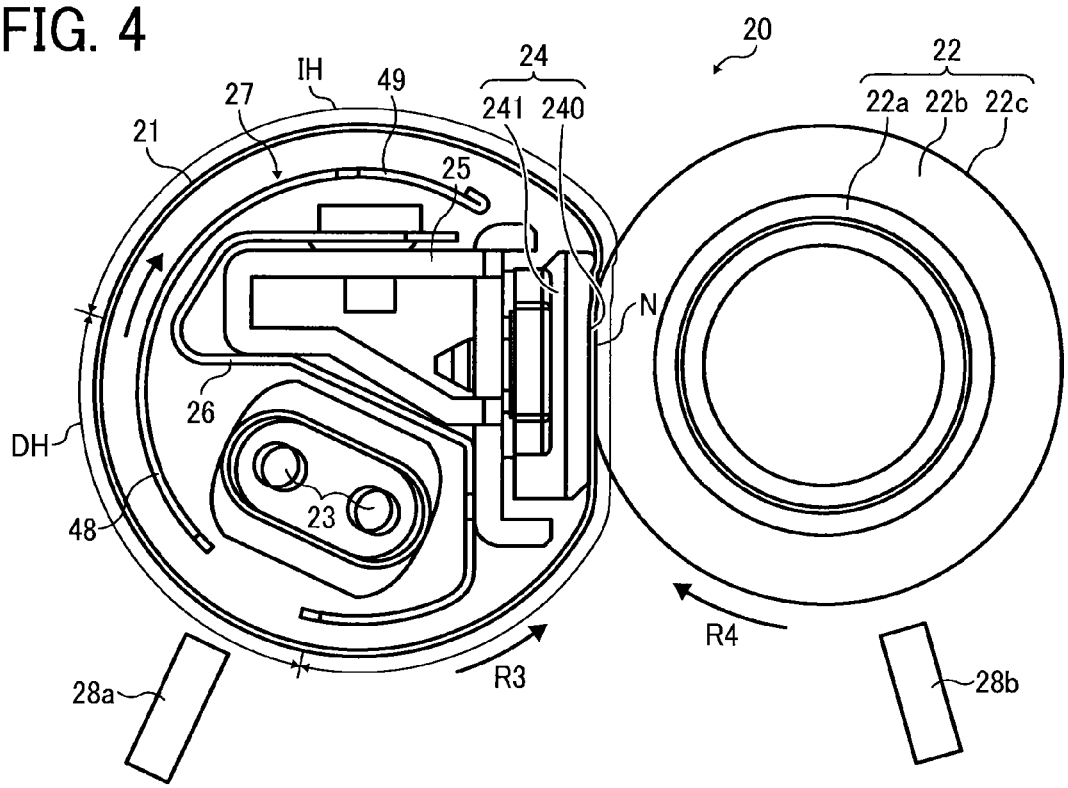
FIG. 4 is a vertical sectional view of the fixing device shown in FIG. 2 illustrating the heat shield situated at a retracted position.

With reference to FIGS. 2 and 4, a detailed description is now given of a configuration of the heat shield 27.

FIG. 4 is a vertical sectional view of the fixing device 20. The heat shield 27 is a metal plate, having a thickness in a range of from about 0.1 mm to about 1.0 mm, curved in the circumferential direction of the fixing belt 21 along the inner circumferential surface thereof. As shown in FIG. 2, the heat shield 27 is not circular in the circumferential direction of the fixing belt 21. For example, the heat shield 27 is an arc in cross-section arched along the inner circumferential surface of the fixing belt 21. The heat shield 27 is rotatable clockwise and counterclockwise in FIGS. 2 and 4 in the circumferential direction of the fixing belt 21 on a track interposed between the halogen heater pair 23 and the fixing belt 21. As shown in FIG. 2, a circumference of the fixing belt 21 is divided into two sections: a circumferential, direct heating span DH where the halogen heater pair 23 is disposed opposite and heats the fixing belt 21 directly and a circumferential, indirect heating span IH where the halogen heater pair 23 is disposed opposite the fixing belt 21 indirectly via the components other than the heat shield 27, that is, the reflector 26, the stay 25, the nip formation assembly 24, and the like. The heat shield 27 moves to a shield position shown in FIG. 2 where the heat shield 27 is interposed between the halogen heater pair 23 and the fixing belt 21 in the direct heating span DH to shield the fixing belt 21 from light radiated from the halogen heater pair 23. Conversely, the heat shield 27 moves to a retracted position shown in FIG. 4 where the heat shield 27 retracts from the direct heating span DH to the indirect heating span IH and therefore is not interposed between the halogen heater pair 23 and the fixing belt 21. That is, the heat shield 27 is behind the reflector 26 and the stay 25 and therefore disposed opposite the halogen heater pair 23 via the reflector 26 and the stay 25. The heat shield 27 is made of a heat resistant material, for example, metal such as aluminum, iron, and stainless steel or ceramic.

Figure 5:
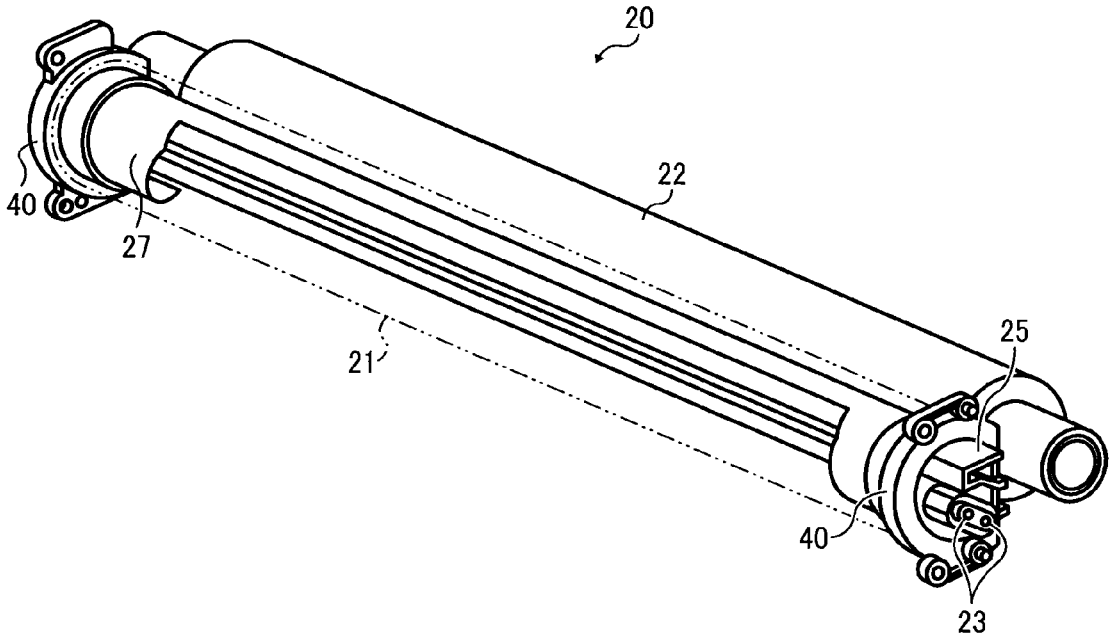
FIG. 5 is a partial perspective view of the fixing device shown in FIG. 4.

With reference to FIG. 5, a description is provided of a configuration of flanges 40 incorporated in the fixing device 20.

FIG. 5 is a partial perspective view of the fixing device 20. As shown in FIG. 5, the flanges 40 serving as a belt holder are inserted into both lateral ends of the fixing belt 21 in the axial direction thereof, respectively, to rotatably support the fixing belt 21. Both lateral ends of the flanges 40, the halogen heater pair 23, and the stay 25 in the axial direction of the fixing belt 21 are mounted on and supported by a pair of side plates of the fixing device 20, respectively.

Figure 6:
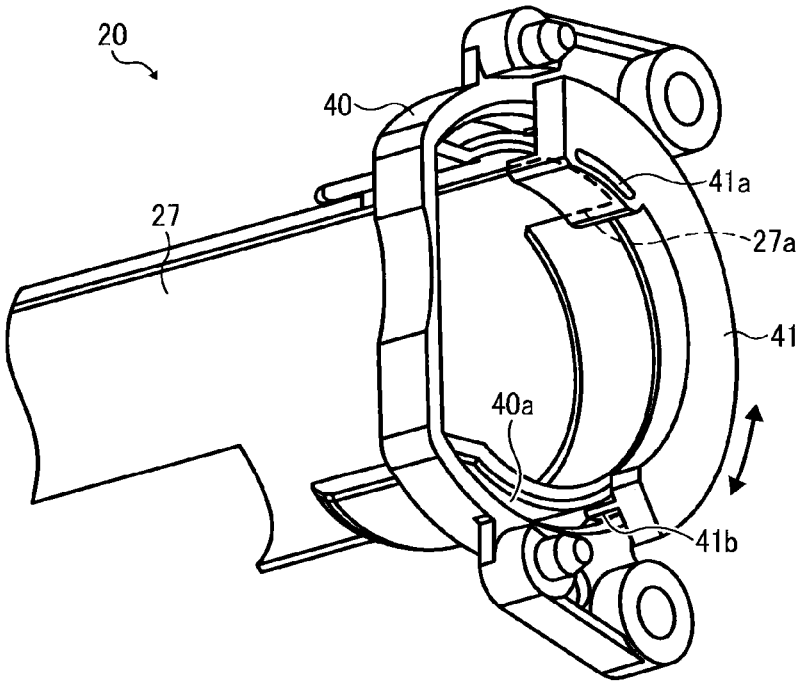
FIG. 6 is a partial perspective view of the fixing device shown in FIG. 2 illustrating one lateral end of the heat shield in an axial direction thereof.

With reference to FIG. 6, a description is provided of a support mechanism that supports the heat shield 27.

FIG. 6 is a partial perspective view of the fixing device 20 illustrating one lateral end of the heat shield 27 in the axial direction of the fixing belt 21. As shown in FIG. 6, the heat shield 27 is supported by an arcuate slider 41 rotatably or slidably attached to the flange 40. For example, a projection 27*a* disposed at each lateral end of the heat shield 27 in the axial direction of the fixing belt 21 is inserted into a hole 41*a* produced in the slider 41. Thus, the heat shield 27 is attached to the slider 41. The slider 41 includes a tab 41*b* projecting inboard in the axial direction of the fixing belt 21 toward the heat shield 27. As the tab 41*b* of the slider 41 is inserted into an arcuate groove 40*a* produced in the flange 40, the slider 41 is slidably movable in the groove 40*a*. Accordingly, the heat shield 27, together with the slider 41, is rotatable or movable in a circumferential direction of the flange 40. The flange 40 and the slider 41 are made of resin.

Although FIG. 6 illustrates the support mechanism that supports the heat shield 27 at one lateral end thereof in the axial direction of the fixing belt 21, another lateral end of the heat shield 27 in the axial direction of the fixing belt 21 is also supported by the support mechanism shown in FIG. 6. Thus, another lateral end of the heat shield 27 is also rotatably or movably supported by the slider 41 slidable in the groove 40*a* of the flange 40.

Figure 7:
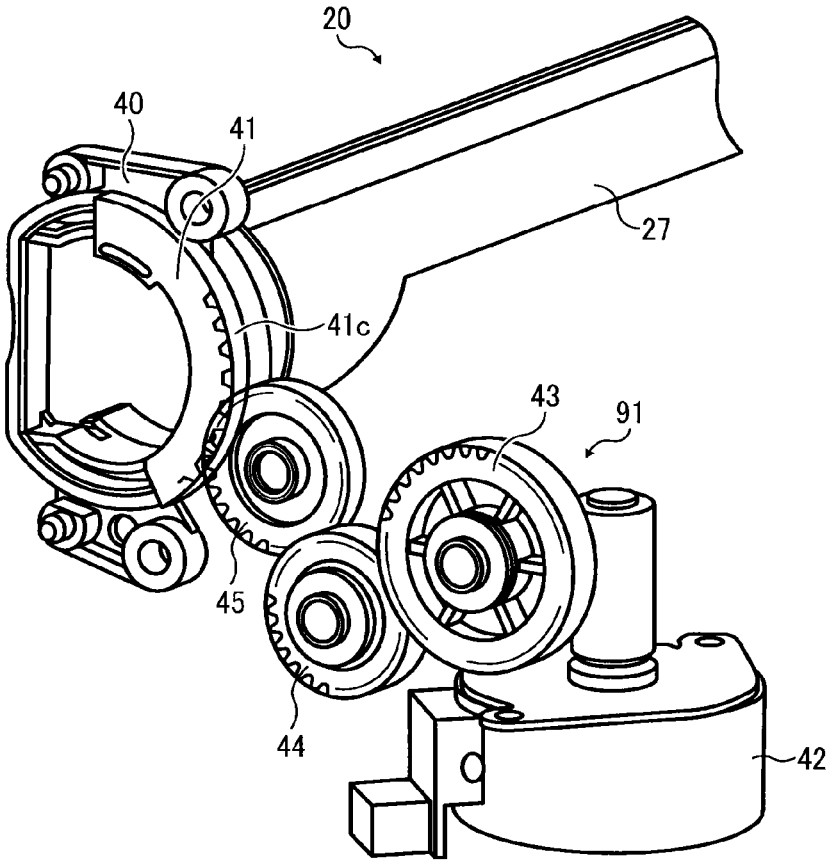
FIG. 7 is a partial perspective view of the fixing device shown in FIG. 2 illustrating a driver incorporated therein.

With reference to FIG. 7, a description is provided of a construction of a driver 91 that drives and rotates the heat shield 27.

FIG. 7 is a partial perspective view of the fixing device 20 illustrating the driver 91. As shown in FIG. 7, the driver 91 includes a motor 42 serving as a driving source and a plurality of gears 43, 44, and 45 constituting a gear train. The gear 43 serving as one end of the gear train is connected to the motor 42. The gear 45 serving as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the heat shield 27 supported by the slider 41.

Figure 8:
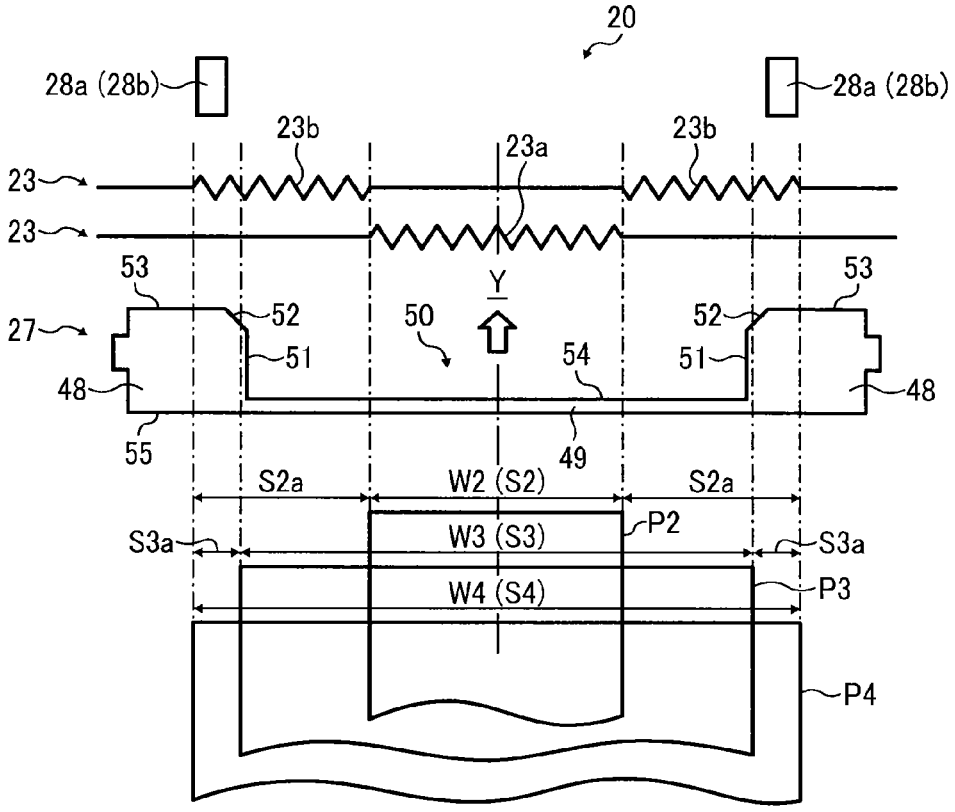
FIG. 8 is a schematic diagram of the fixing device shown in FIG. 4 illustrating a halogen heater pair incorporated therein, the heat shield, and the sizes of recording media.

With reference to FIG. 8, a description is provided of a relation between the shape of the heat shield 27, heat generators of the halogen heater pair 23, and the sizes of recording media.

FIG. 8 is a schematic diagram of the fixing device 20 illustrating the halogen heater pair 23, the heat shield 27, and the sizes of recording media.

First, a detailed description is given of the shape of the heat shield 27.

It is to be noted that an axial direction of the heat shield 27 defines a direction in which an axis of the heat shield 27 extends in the axial direction of the fixing belt 21. A circumferential direction of the heat shield 27 defines a direction in which the heat shield 27 rotates in the circumferential direction of the fixing belt 21.

As shown in FIG. 8, the heat shield 27 includes a pair of shield portions 48 constituting both lateral ends of the heat shield 27 in the axial direction thereof, respectively; a bridge 49 bridging the shield portions 48 in the axial direction of the heat shield 27; and a recess 50 defined by the shield portions 48 and the bridge 49, and in turn itself defining an inboard edge of each shield portion 48. The recess 50 between the pair of shield portions 48 in the axial direction of the heat shield 27 is defined and enclosed by the inboard edge of each shield portion 48 in the axial direction of the heat shield 27 and an inner edge 54 of the bridge 49, that is, one end of the bridge 49 in the circumferential direction of the heat shield 27, constituting a bottom of the recess 50. The shield portions 48 are disposed opposite both lateral ends of the halogen heater pair 23 in the axial direction of the fixing belt 21, respectively, to shield both lateral ends of the fixing belt 21 in the axial direction thereof from the halogen heater pair 23. In the present embodiment, the pair of shield portions 48 and the bridge 49 constituting the heat shield 27 are in a single metal plate. The recess 50 between the pair of shield portions 48 in the axial direction of the heat shield 27 does not shield the fixing belt 21 from the halogen heater pair 23 and therefore allows light radiated from the halogen heater pair 23 to irradiate the fixing belt 21.

Each shield portion 48 includes an axially straight edge 53 constituting one end of the shield portion 48 in the circumferential direction of the heat shield 27 and extending in the axial direction thereof. The axially straight edge 53 extends substantially throughout the entire width of the shield portion 48 in the axial direction of the heat shield 27 except for a sloped edge 52, a detailed description of which is deferred. The axially straight edge 53 of the shield portion 48 is disposed downstream from the inner edge 54 of the bridge 49 in the rotation direction R3 of the fixing belt 21 depicted in FIG. 2. For example, the shield portions 48 are disposed downstream from the bridge 49 in a shield direction Y, equivalent to the rotation direction R3 of the fixing belt 21, in which the heat shield 27 rotates and moves to the shield position shown in FIG. 2. The inner edge 54 of the bridge 49 is connected to the axially straight edge 53 of one shield portion 48 through the inboard edge of the shield portion 48 that is disposed opposite the inboard edge of another shield portion 48. The inboard edge of the shield portion 48 includes a circumferentially straight edge 51 extending parallel to the circumferential direction of the heat shield 27 in which the heat shield 27 rotates and the sloped edge 52 angled relative to the circumferentially straight edge 51.

As shown in FIG. 8, the sloped edge 52 is contiguous to the circumferentially straight edge 51 substantially in the shield direction Y. The sloped edge 52 is angled outboard from the circumferentially straight edge 51 substantially in the shield direction Y such that an interval between the sloped edge 52 and another sloped edge 52 increases. Accordingly, the recess 50 has a uniform, decreased width defined by the circumferentially straight edges 51 in the axial direction of the heat shield 27 and an increased width defined by the sloped edges 52 in the axial direction of the heat shield 27 that increases gradually in the shield direction Y. An outer edge 55 of the heat shield 27 situated at another end of the heat shield 27 in the circumferential direction thereof and defining an outer edge of the bridge 49 and the shield portions 48 extends straight in the axial direction of the heat shield 27.

Next, a detailed description is given of a relation between the heat generators of the halogen heater pair 23 and the sizes of recording media.

As shown in FIG. 8, the halogen heater pair 23 has a plurality of heat generators having different lengths in the axial direction of the fixing belt 21 and being situated at different positions in the axial direction of the fixing belt 21 to heat different axial spans on the fixing belt 21 according to the size of the recording medium P. For example, the halogen heater pair 23 is constructed of the lower halogen heater 23 having a center heat generator 23*a* disposed opposite a center of the fixing belt 21 in the axial direction thereof and the upper halogen heater 23 having lateral end heat generators 23*b* disposed opposite both lateral ends of the fixing belt 21 in the axial direction thereof, respectively. The center heat generator 23*a* spans a conveyance span S2 corresponding to a width W2 of a medium recording medium P2 in the axial direction of the fixing belt 21. Conversely, the lateral end heat generators 23*b*, together with the center heat generator 23*a*, span a conveyance span S3 corresponding to a width W3 of a large recording medium P3 greater than the width W2 of the medium recording medium P2 and a conveyance span S4 corresponding to a width W4 of an extra-large recording medium P4 greater than the width W3 of the large recording medium P3.

A detailed description is now given of a relation between the shape of the heat shield 27 and the sizes of the recording media P2, P3, and P4.

Each circumferentially straight edge 51 is situated inboard from and in proximity to an edge of the conveyance span S3 corresponding to the width W3 of the large recording medium P3 in the axial direction of the fixing belt 21. Each sloped edge 52 overlaps a side edge of a standard size recording medium in the axial direction of the fixing belt 21. According to this exemplary embodiment, each sloped edge 52 overlaps the edge of the conveyance span S3 corresponding to the width W3 of the large recording medium P3 as the standard size recording medium in the axial direction of the fixing belt 21.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, examples of the sizes of recording media are not limited to the above. Additionally, the medium, large, and extra-large sizes mentioned herein are relative terms. Hence, instead of the medium, large, and extra-large sizes, small, medium, and large sizes may be used.

With reference to FIG. 2, a description is provided of a fixing operation of the fixing device 20 described above.

As the image forming apparatus 1 depicted in FIG. 1 is powered on, the power supply supplies power to the halogen heater pair 23 and at the same time the driver drives and rotates the pressing roller 22 clockwise in FIG. 2 in the rotation direction R4. Accordingly, the fixing belt 21 rotates counterclockwise in FIG. 2 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the fixing belt 21 and the pressing roller 22 pressed against the fixing belt 21. The fixing belt 21 heated by the halogen heater pair 23 heats the recording medium P and at the same time the pressing roller 22 pressed against the fixing belt 21, together with the fixing belt 21, exerts pressure on the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of a separator, the separator separates the recording medium P from the fixing belt 21. Thereafter, the separated recording medium P is discharged by the output roller pair 13 depicted in FIG. 1 onto the outside of the image forming apparatus 1, that is, the output tray 14 where the recording medium P is stocked.

With reference to FIG. 8, a description is provided of control of the halogen heater pair 23 and the heat shield 27 according to the sizes of recording media.

As the medium recording medium P2 is conveyed over the fixing belt 21 depicted in FIG. 2, the controller 90 depicted in FIG. 3 turns on the center heat generator 23*a* to heat the conveyance span S2 of the fixing belt 21 corresponding to the width W2 of the medium recording medium P2. As the extra-large recording medium P4 is conveyed over the fixing belt 21, the controller 90 turns on the lateral end heat generators 23*b* as well as the center heat generator 28*a* to heat the conveyance span S4 of the fixing belt 21 corresponding to the width W4 of the extra-large recording medium P4.

However, as described above, the halogen heater pair 23 is configured to heat the conveyance span S2 corresponding to the width W2 of the medium recording medium P2 and the conveyance span S4 corresponding to the width W4 of the extra-large recording medium P4. Accordingly, if the center heat generator 23*a* is turned on as the large recording medium P3 is conveyed over the fixing belt 21, the center heat generator 23*a* does not heat each outboard span S2*a* outboard from the conveyance span S2 in the axial direction of the fixing belt 21. Consequently, the large recording medium P3 is not heated throughout the entire width W3 thereof. Conversely, if the lateral end heat generators 23*b* are turned on in addition to the center heat generator 23*a*, the lateral end heat generators 23*b* and the center heat generator 23*a* heat the conveyance span S4 greater than the conveyance span S3 corresponding to the width W3 of the large recording medium P3. If the large recording medium P3 is conveyed over the fixing belt 21 while the lateral end heat generators 23*b* and the center heat generator 23*a* are turned on, the lateral end heat generators 23*b* may heat both outboard spans S3*a* outboard from the conveyance span S3 corresponding to the width W3 of the large recording medium P3, resulting in overheating of the fixing belt 21 in the outboard spans S3*a*.

Figure 9:
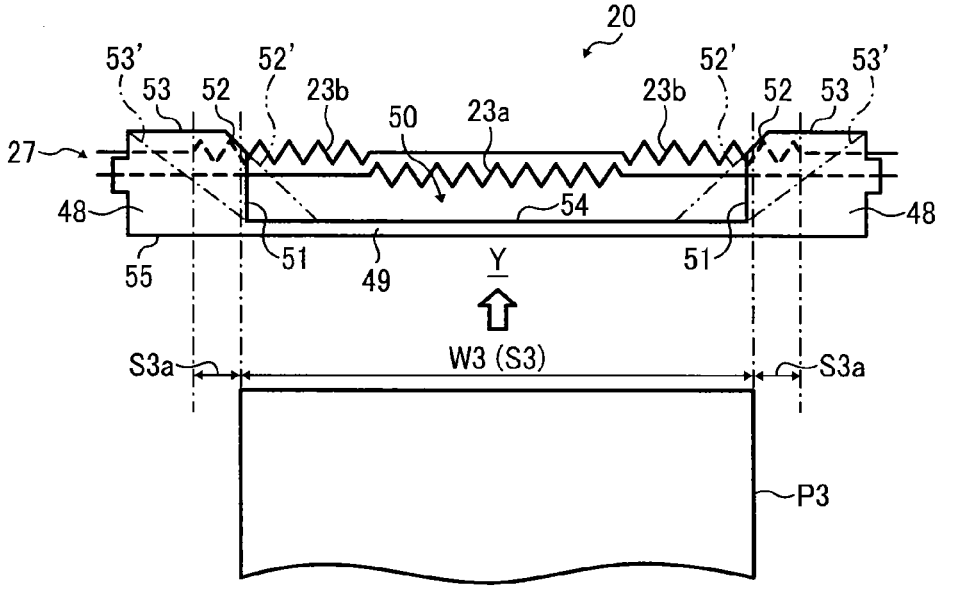
FIG. 9 is a schematic diagram of the fixing device shown in FIG. 2 illustrating the heat shield at the shield position.

To address this circumstance, as the large recording medium P3 is conveyed over the fixing belt 21, the heat shield 27 moves to the shield position as shown in FIG. 9. FIG. 9 is a schematic diagram of the fixing device 20. At the shield position shown in FIG. 9, the shield portions 48 of the heat shield 27 shield the fixing belt 21 in a region in proximity to both side edges of the large recording medium P3 and the outboard spans S3*a*, thus suppressing overheating of the fixing belt 21 in the outboard spans S3*a* where the large recording medium P3 is not conveyed.

Since the shield portions 48 are not endless in the circumferential direction of the fixing belt 21, as the heat shield 27 rotates, the shield portions 48 shield the fixing belt 21 from the halogen heater pair 23 in a variable area on the fixing belt 21. For example, as the heat shield 27 rotates in the shield direction Y toward the shield position shown in FIG. 2, the shield portions 48 shield the fixing belt 21 in an increased area. Conversely, as the heat shield 27 rotates in a retract direction counter to the shield direction Y toward the retracted position shown in FIG. 4, the shield portions 48 shield the fixing belt 21 in a decreased area.

Since each shield portion 48 includes the sloped edge 52, as the rotation angle of the heat shield 27 changes, the shield portions 48 shield the fixing belt 21 in a variable area changed by stepless adjustment, especially at a smallest interval between the lateral end heat generators 23*b* and the fixing belt 21.

Figure 10:
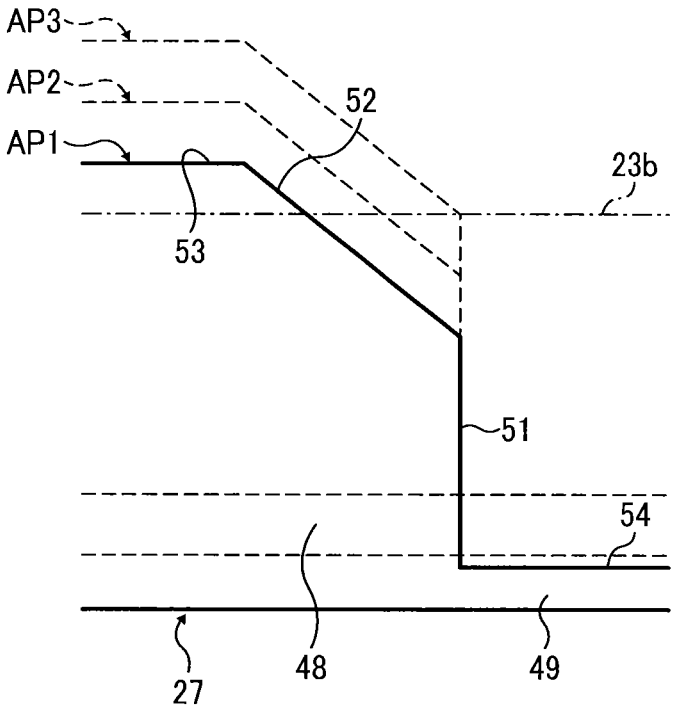
FIG. 10 is a partially enlarged plan view of the heat shield shown in FIG. 8.

With reference to FIG. 10, a description is provided of rotation angled positions of the heat shield 27.

FIG. 10 is a partially enlarged plan view of the heat shield 27. FIG. 10 illustrates the heat shield 27 at three rotation angled positions, that is, a first rotation angled position AP1, a second rotation angled position AP2, and a third rotation angled position AP3 selectable according to the size of the recording medium P. Alternatively, the heat shield 27 may be rotatable to two rotation angled positions or four or more rotation angled positions.

As shown in FIG. 10, a plurality of rotation angled positions is available to correspond to the plurality of sizes of the recording media. For example, the sloped edge 52 overlapping the side edge of the large recording medium P3 in the axial direction of the heat shield 27 as shown in FIG. 9 overlaps the lateral end heat generator 23*b* partially illustrated in FIG. 10 in the circumferential direction of the heat shield 27 at the plurality of rotation angled positions of the heat shield 27.

With reference to FIG. 9, a description is provided of the slope of the shield portion 48 of the heat shield 27.

As shown in FIG. 9, the shield portion 48 may include a sloped edge 53', indicated by the alternate long and short dashed line in FIG. 9, which forms the shield portion 48 into a triangle, instead of the sloped edge 52 and the axially straight edge 53. The sloped edge 53' is contiguous to and angled relative to the inner edge 54 of the bridge 49 extending in the axial direction of the heat shield 27, increasing the slope of the shield portion 48 that changes the variable area on the fixing belt 21 shielded by the shield portion 48. However, since the sloped edge 53' decreases the area of the shield portion 48 compared to the sloped edge 52, the sloped edge 53' decreases an amount of light from the halogen heater pair 23 that is shielded by the shield portion 48, overheating the fixing belt 21. To address this circumstance, it is preferable that the shield portion 48 includes the axially straight edge 53 indicated by the solid line in FIG. 9 that extends in the axial direction of the heat shield 27 at one end of the heat shield 27 in the circumferential direction thereof.

Alternatively, the shield portion 48 may include a sloped edge 52' indicated by the alternate long and two short dashed line in FIG. 9 that forms the shield portion 48 into a trapezoid, instead of the sloped edge 52. The sloped edge 52' is contiguous to the axially straight edge 53 and the inner edge 54 of the bridge 49 and angled relative to the inner edge 54 of the bridge 49. Since the sloped edge 52' decreases the area of the recess 50, the sloped edge 52' may allow the halogen heater pair 23 to heat the fixing belt 21 in a decreased area, resulting in insufficient heating of the fixing belt 21 in the conveyance span S3 corresponding to the width W3 of the large recording medium P3, for example. To address this circumstance, it is preferable that the shield portion 48 includes the circumferentially straight edge 51 abutting the recess 50 to secure the desired area of the recess 50.

When a fixing job is finished or the temperature of the outboard span S3*a* of the fixing belt 21 where the large recording medium P3 is not conveyed decreases to a predetermined threshold and therefore the heat shield 27 is no longer requested to shield the fixing belt 21, the controller 90 moves the heat shield 27 to the retracted position shown in FIG. 4. Thus, the fixing device 20 performs the fixing job precisely by moving the heat shield 27 to the shield position shown in FIG. 2 at a proper time without decreasing the rotation speed of the fixing belt 21 and the pressing roller 22 to convey the large recording medium P3. Whether the heat shield 27 is at the shield position shown in FIG. 2 or at the retracted position shown in FIG. 4, the bridge 49 of the heat shield 27 is disposed opposite the indirect heating span IH shown in FIGS. 2 and 4. Accordingly, the bridge 49 does not receive light from the halogen heater pair 23 directly.

As shown in FIGS. 2 and 4, a rotation axis of the heat shield 27 is situated in proximity to a center of the fixing belt 21 in cross-section, that is, a rotation axis of the fixing belt 21; a center of the halogen heater pair 23, that is, a center of a filament of each of the center heat generator 23*a* and the lateral end heat generators 23*b* is situated closer to the inner circumferential surface of the fixing belt 21 than the rotation axis of the heat shield 27 is. Accordingly, at the shield position shown in FIG. 2, the heat shield 27 is disposed opposite the halogen heater pair 23 with a decreased interval therebetween. Conversely, at the retracted position shown in FIG. 4, the heat shield 27 is disposed opposite the halogen heater pair 23 with an increased interval therebetween. Consequently, at the retracted position, the heat shield 27 is less exposed to light radiated from the halogen heater pair 23 and therefore is less susceptible to overheating.

As shown in FIG. 4, since the nip formation assembly 24 is situated inside the loop formed by the fixing belt 21, the nip formation assembly 24 prohibits the heat shield 27 from moving to the fixing nip N. To address this circumstance, the halogen heater pair 23 is situated upstream from the fixing nip N in the rotation direction R3 of the fixing belt 21 so that the heat shield 27 is movable between the shield position shown in FIG. 2 where the heat shield 27 is situated at an upstream position upstream from the fixing nip N in the rotation direction R3 of the fixing belt 21 and the retracted position shown in FIG. 4 where the heat shield 27 is situated at a downstream position downstream from the fixing nip N in the rotation direction R3 of the fixing belt 21. Accordingly, the heat shield 27 retracts to the downstream, retracted position shown in FIG. 4 where the nip formation assembly 24 does not interfere with movement of the heat shield 27 while increasing a circumferential moving span of the heat shield 27 that moves in the circumferential direction of the fixing belt 21. Such configuration to increase the circumferential moving span of the heat shield 27 is advantageous for the fixing device 20 incorporating the fixing belt 21 having a smaller diameter to reduce its thermal capacity because the smaller fixing belt 21 creates a smaller loop, and thus, a smaller enclosed, interior space.

The temperature sensor 28*a* for detecting the temperature of the fixing belt 21 is disposed opposite an axial span on the fixing belt 21 where the fixing belt 21 is subject to overheating. According to this exemplary embodiment, as shown in FIG. 8, the temperature sensor 28*a* is disposed opposite each outboard span S3*a* outboard from the conveyance span S3 corresponding to the width W3 of the large recording medium P3 because the fixing belt 21 is subject to overheating in the outboard span S3*a*. Since the fixing belt 21 is subject to overheating by the lateral end heat generators 23*b*, the temperature sensors 28*a* are disposed opposite the lateral end heat generators 23*b*, respectively.

With reference to FIGS. 2 to 4 and 11, a description is provided of one example of a control method for controlling the rotation angle of the heat shield 27.

Figure 11:
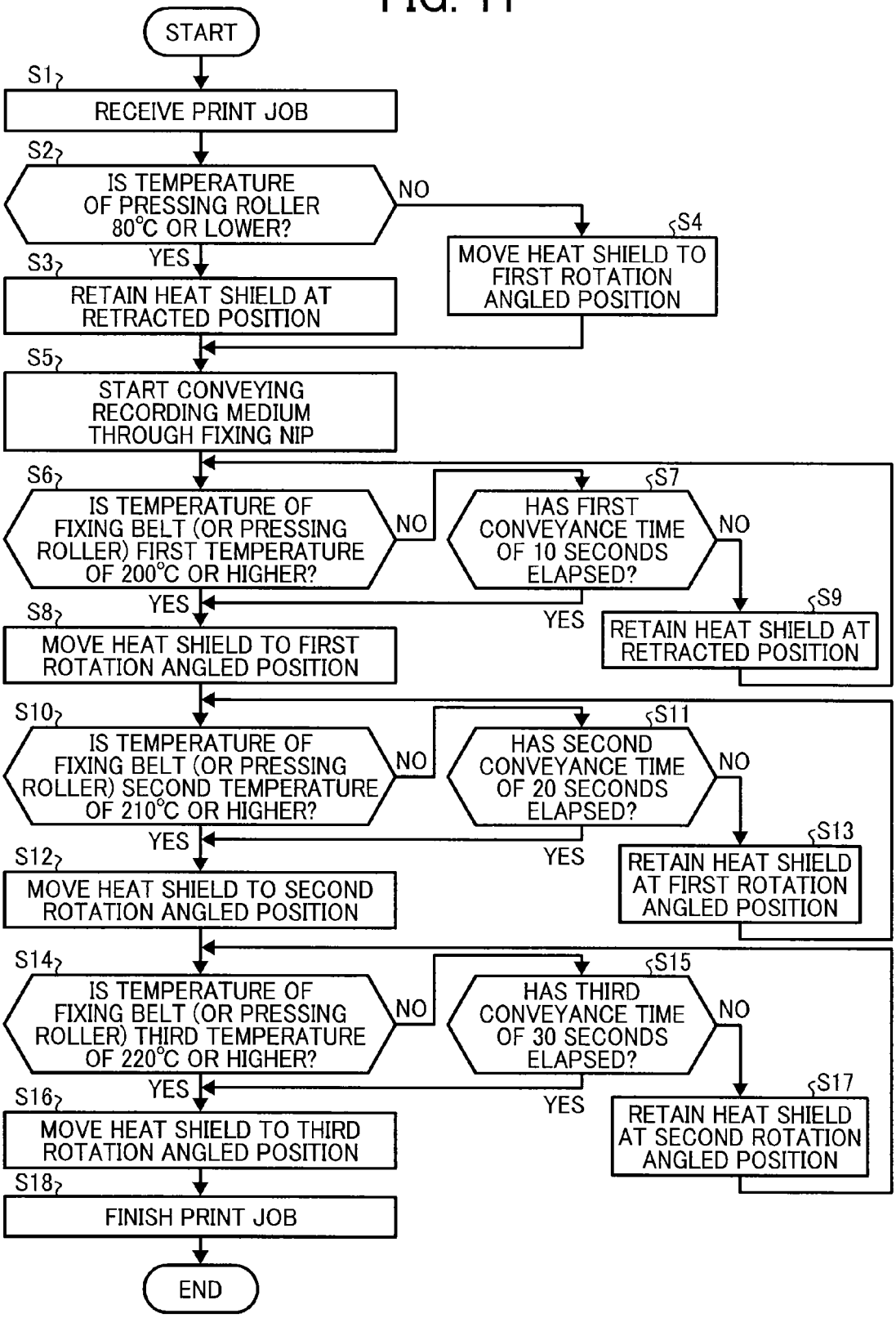
FIG. 11 is a flowchart illustrating control processes for controlling the rotation angle of the heat shield shown in FIG. 10.

FIG. 11 is a flowchart illustrating control processes of the control method. It is to be noted that the heat shield 27 is at the retracted position shown in FIG. 4 by default.

In step S1, upon receipt of a print job, the controller 90 receives information about the size of a recording medium, that is, a large recording medium P3 of A3 size according to this example, and the number of prints, that is, the number of the recording media P3 conveyed through the fixing nip N. In step S2, immediately after receiving the print job, the controller 90 determines storage of heat of the fixing device 20 based on the temperature of the outer circumferential surface of the pressing roller 22 detected by the temperature sensor 28*b*. For example, the controller 90 determines whether or not the temperature of the pressing roller 22 is a predetermined temperature of 80 degrees centigrade or smaller. If the temperature of the pressing roller 22 is 80 degrees centigrade or lower (YES in step S2), the controller 90 determines that the fixing device 20 stores an insufficient amount of heat, retaining the heat shield 27 at the default retracted position shown in FIG. 4 without moving the heat shield 27 in step S3. Conversely, if the temperature of the pressing roller 22 is higher than 80 degrees centigrade (NO in step S2), the controller 90 determines that the fixing device 20 stores a sufficient amount of heat and controls the driver 91 to move the heat shield 27 to the shield position shown in FIG. 2 in step S4. For example, the heat shield 27 halts at the first rotation angled position AP1 selected from among the first rotation angled position AP1, the second rotation angled position AP2, and the third rotation angled position AP3 shown in FIG. 10 that are available for the width W3 of the large recording medium P3.

It is to be noted that the controller 90 determines storage of heat of the fixing device 20 based on the temperature of the pressing roller 22 immediately after receipt of the print job. Conversely, the controller 90 moves the heat shield 27 based on such determination after the temperature of the outer circumferential surface of the fixing belt 21 reaches a predetermined fixing temperature and before the large recording medium P3 enters the fixing nip N.

Thus, before the large recording medium P3 is conveyed through the fixing nip N, the controller 90 moves the heat shield 27 based on storage of heat of the fixing device 20, that is, the temperature of the pressing roller 22, and halts the heat shield 27 at the rotation angled position determined based on the size of the large recording medium P3 and storage of heat of the fixing device 20, that is, the temperature of the pressing roller 22.

In step S5, the large recording medium P3 enters the fixing nip N. While the large recording medium P3 is conveyed through the fixing nip N, the controller 90 monitors the temperature of the fixing belt 21 detected by the temperature sensor 28*a* constantly. For example, the controller 90 determines whether or not the temperature of the fixing belt 21 is a predetermined first temperature of 200 degrees centigrade or higher in step S6. If the controller 90 determines that the temperature of the fixing belt 21 is 200 degrees centigrade or higher (YES in step S6), the controller 90 controls the driver 91 to move the heat shield 27 to the first rotation angled position AP1 in step S8. Conversely, if the controller 90 determines that the temperature of the fixing belt 21 is lower than 200 degrees centigrade (NO in step S6), the controller 90 does not move the heat shield 27 and therefore retains the heat shield 27 at the default retracted position in step S9. It is to be noted that if the heat shield 27 is already at the first rotation angled position AP1 based on storage of heat of the fixing device 20 or a conveyance time elapsed from starting of conveyance of the large recording medium P, a detailed description of which is deferred, even if the temperature of the fixing belt 21 is 200 degrees centigrade or higher, the controller 90 does not move the heat shield 27 and therefore retains the heat shield 27 at the first rotation angled position AP1.

According to this exemplary embodiment, in addition to monitoring the temperature of the fixing belt 21, the controller 90 monitors the conveyance time elapsed from starting of conveyance of the large recording medium P3 through the fixing nip N. For example, the controller 90 determines whether or not a predetermined first conveyance time of 10 seconds has elapsed after the large recording medium P3 enters the fixing nip N in step S7. If the controller 90 determines that the first conveyance time has elapsed (YES in step S7), the controller 90 controls the driver 91 to move the heat shield 27 to the first rotation angled position AP1 selected from among the first rotation angled position AP1, the second rotation angled position AP2, and the third rotation angled position AP3 that are available for the large recording medium P3 in step S8. Conversely, if the controller 90 determines that the first conveyance time has not elapsed (NO in step S7), the controller 90 retains the heat shield 27 at the retracted position in step S9. It is to be noted that if the heat shield 27 is already at the first rotation angled position AP1 based on storage of heat of the fixing device 20 or the temperature of the fixing belt 21, even if the first conveyance time of 10 seconds has elapsed, the controller 90 does not move the heat shield 27 and therefore retains the heat shield 27 at the first rotation angled position AP1.

Thereafter, as the print job continues, the controller 90 determines whether or not the temperature of the fixing belt 21 is a predetermined second temperature of 210 degrees centigrade or higher in step S10. Simultaneously, the controller 90 determines whether or not a predetermined second conveyance time of 20 seconds has elapsed in step S11. If the controller 90 determines that the temperature of the fixing belt 21 is the predetermined second temperature or higher (YES in step S10) or the predetermined second conveyance time has elapsed (YES in step S11), the controller 90 controls the driver 91 to move the heat shield 27 to the second rotation angled position AP2 in step S12. Conversely, if the controller 90 determines that the temperature of the fixing belt 21 is lower than the predetermined second temperature (NO in step S10) and the predetermined second conveyance time of 20 seconds has not elapsed (NO in step S11), the controller 90 does not move the heat shield 27 and therefore retains the heat shield 27 at the first rotation angled position AP1 in step S13.

Thereafter, as the print job continues, the controller 90 determines whether or not the temperature of the fixing belt 21 is a predetermined third temperature of 220 degrees centigrade or higher in step S14. Simultaneously, the controller 90 determines whether or not a predetermined third conveyance time of 30 seconds has elapsed in step S15. If the controller 90 determines that the temperature of the fixing belt 21 is the predetermined third temperature or higher (YES in step S14) or the predetermined third conveyance time has elapsed (YES in step S15), the controller 90 controls the driver 91 to move the heat shield 27 to the third rotation angled position AP3 in step S16. Conversely, if the controller 90 determines that the temperature of the fixing belt 21 is lower than the predetermined third temperature (NO in step S14) and the predetermined third conveyance time of 30 seconds has not elapsed (NO in step S15), the controller 90 does not move the heat shield 27 and therefore retains the heat shield 27 at the second rotation angled position AP2 in step S17.

Thus, during the print job, that is, from starting of conveyance of the large recording medium P3 through the fixing nip N until the print job is finished, the controller 90 moves the heat shield 27 based on the temperature of the fixing belt 21 predicted from the temperature of the pressing roller 22 and selects the rotation angled position from among the first rotation angled position AP1, the second rotation angled position AP2, and the third rotation angled position AP3 based on the size of the large recording medium P3 and the temperature of the fixing belt 21.

Finally, in step S18, the print job is finished.

It is to be noted that when the received print job is finished, printing stops even during the processes described above. For example, if the controller 90 controls the rotation angle of the heat shield 27 based on the size of the recording medium P, once the controller 90 receives information about the size of the recording medium P, the controller 90 moves the heat shield 27 to the rotation angled position corresponding to the size of the recording medium P irrespective of the temperature of the fixing belt 21 and the pressing roller 22. In this case, when the fixing device 20 is maintained substantially at an ambient temperature upon starting a print job after the fixing device 20 is turned off for a substantial time, the heat shield 27 may move to the shield position shown in FIG. 2 even when the fixing belt 21 is heated insufficiently, thus shielding the fixing belt 21 from the halogen heater pair 23 and thereby increasing a warm-up time to warm up the fixing belt 21. Further, once the heat shield 27 moves to the rotation angled position corresponding to the size of the recording medium P, the heat shield 27 is retained at the rotation angled position until the print job is finished. Accordingly, even if the temperature of the fixing belt 21 increases accidentally, the heat shield 27 may not be moved.

To address this circumstance, the fixing device 20 moves the heat shield 27 based on storage of heat of the fixing device 20, that is, the temperature of the pressing roller 22, before the recording medium P enters the fixing nip N. Conversely, the fixing device 20 moves the heat shield 27 based on the temperature of the fixing belt 21 during the print job. Accordingly, the controller 90 moves the heat shield 27 at the proper time based on the temperature of the fixing belt 21 or the pressing roller 22, thus shielding the fixing belt 21 from the halogen heater pair 23.

As shown in FIG. 8, since the temperature sensor 28*a* is disposed opposite a part of the fixing belt 21 in the axial direction thereof, that is, the outboard span S3*a*, the temperature sensor 28*a* does not detect the temperature of other part of the fixing belt 21 in the axial direction thereof, that is, a center of the fixing belt 21 in the axial direction thereof, for example. Further, the temperature of the fixing belt 21 may increase sharply during the print job. In this case, if the controller 90 moves the heat shield 27 after the temperature sensor 28*a* detects the temperature of the fixing belt 21, it may be too late to prevent overheating of the fixing belt 21. Hence, if the controller 90 moves the heat shield 27 based on the temperature of the fixing belt 21, the heat shield 27 may not move at the proper time, resulting in overheating of the fixing belt 21 in both lateral ends in the axial direction thereof.

To address this circumstance, the controller 90 of the fixing device 20 moves the heat shield 27 based on the conveyance time elapsed after the recording medium P enters the fixing nip N in addition to the temperature of the fixing belt 21. For example, the controller 90 obtains in advance data about a relation between the conveyance time for conveying the recording media P of sizes available in the fixing device 20 and the temperature of the fixing belt 21 from past print data and experimental results. Thus, the controller 90 presets the conveyance time based on which the heat shield 27 is moved according to the relation between the conveyance time and the temperature of the fixing belt 21. Hence, by moving the heat shield 27 based on the conveyance time and the temperature of the fixing belt 21, even if it is difficult to prevent overheating of the fixing belt 21 by moving the heat shield 27 solely based on the temperature of the fixing belt 21, the controller 90 moves the heat shield 27 at the proper time to shield the fixing belt 21 from the halogen heater pair 23.

The controller 90 incorporated in the fixing device 20 determines the rotation angled position of the heat shield 27 based on the size of the recording medium P and the temperature of the pressing roller 22 or the fixing belt 21. Accordingly, the controller 90 determines a shielded span on the fixing belt 21 that is shielded by the heat shield 27 from the halogen heater pair 23 so that the temperature of the fixing belt 21 is in a proper range. Consequently, overheating of the fixing belt 21 at both lateral ends in the axial direction thereof is prevented. For example, the sloped edge 52 of the heat shield 27 allows fine adjustment of the shielded span on the fixing belt 21. Accordingly, the heat shield 27 is moved to a desired rotation angled position based on the temperature of the pressing roller 22 or the fixing belt 21. Further, the controller 90 selects a single rotation angled position from among the plurality of rotation angled positions, that is, the first rotation angled position AP1, the second rotation angled position AP2, and the third rotation angled position AP3 available to the plurality of sizes of the recording media P, based on the temperature of the pressing roller 22 or the fixing belt 21. Accordingly, the controller 90 determines a desired rotation angled position using an uncomplicated control process.

Additionally, the controller 90 moves the heat shield 27 based on the size of the recording medium P and the conveyance time. Accordingly, even if it is difficult for the controller 90 to determine the rotation angled position of the heat shield 27 based on the temperature of the fixing belt 21 during the print job, the controller 90 predicts the temperature of the fixing belt 21 from the conveyance time, thus determining the rotation angled position of the heat shield 27 precisely.

A description is provided of alternative configurations of the fixing device 20.

With reference to FIGS. 2 and 11, a detailed description is now given of a first alternative configuration of the fixing device 20.

According to the exemplary embodiments described above with reference to FIG. 11, the controller 90 of the fixing device 20 determines the rotation angled position of the heat shield 27 based on the temperature of the fixing belt 21 during the print job. Alternatively, the controller 90 may determine the rotation angled position of the heat shield 27 based on the temperature of the pressing roller 22 as mentioned in steps S6, S10, and S14 in FIG. 11. Since the pressing roller 22 rotates in the rotation direction R4 while contacting the fixing belt 21, the controller 90 predicts the temperature of the fixing belt 21 from the temperature of the pressing roller 22. Accordingly, even if it is difficult to add the temperature sensor 28*a* for detecting the temperature of the fixing belt 21 due to limited space inside the fixing device 20 or the image forming apparatus 1, the controller 90 determines a time to move the heat shield 27 and the rotation angled position of the heat shield 27 based on the temperature of the pressing roller 22 detected by the temperature sensors 28*b*. In this case, similarly to the temperature sensors 28*a*, the temperature sensors 28*b* for detecting the temperature of the pressing roller 22 are disposed opposite the outboard spans S3*a* on the pressing roller 22 outboard from the conveyance span S3 corresponding to the width W3 of the large recording medium P3 in the axial direction of the pressing roller 22 as shown in FIG. 8.

With reference to FIGS. 2 and 11, a detailed description is now given of a second alternative configuration of the fixing device 20.

According to the exemplary embodiments described above with reference to FIG. 11, the controller 90 of the fixing device 20 determines the rotation angled position of the heat shield 27 during the print job based on the size of the recording medium P and the conveyance time as mentioned in steps S7, S11, and S15 in FIG. 11. Additionally or alternatively, the controller 90 may determine the rotation angled position of the heat shield 27 during the print job based on the size of the recording medium P and the number of prints, that is, the number of the recording media P conveyed through the fixing nip N. For example, the controller 90 obtains in advance data about a relation between the number of prints, that is, the number of the recording media P conveyed through the fixing nip N, for printing on the recording media P of sizes available in the fixing device 20 and the temperature of the fixing belt 21 from past print data and from experimental results. Thus, the controller 90 presets the number of prints based on which the heat shield 27 is moved according to the relation between the number of prints and the temperature of the fixing belt 21. When the actual number of prints exceeds the preset number of prints based on which the heat shield 27 is moved, the controller 90 moves the heat shield 27 to the rotation angled position corresponding to the actual number of prints.

With reference to FIG. 8, a detailed description is now given of a third alternative configuration of the fixing device 20.

According to the exemplary embodiments described above with reference to FIG. 8, the controller 90 of the fixing device 20 moves the heat shield 27 in the shield direction Y. Alternatively, the controller 90 may move the heat shield 27 in a retract direction counter to the shield direction Y based on the temperature of the fixing belt 21 or the pressing roller 22. For example, when the temperature of the fixing belt 21 or the pressing roller 22 is a predetermined temperature or lower during the print job, the controller 90 moves the heat shield 27 in the retract direction counter to the shield direction Y toward the retracted position shown in FIG. 4. Accordingly, an increased amount of light from the halogen heater pair 23 irradiates the fixing belt 21, heating the fixing belt 21 to a desired fixing temperature quickly.

Figure 12:
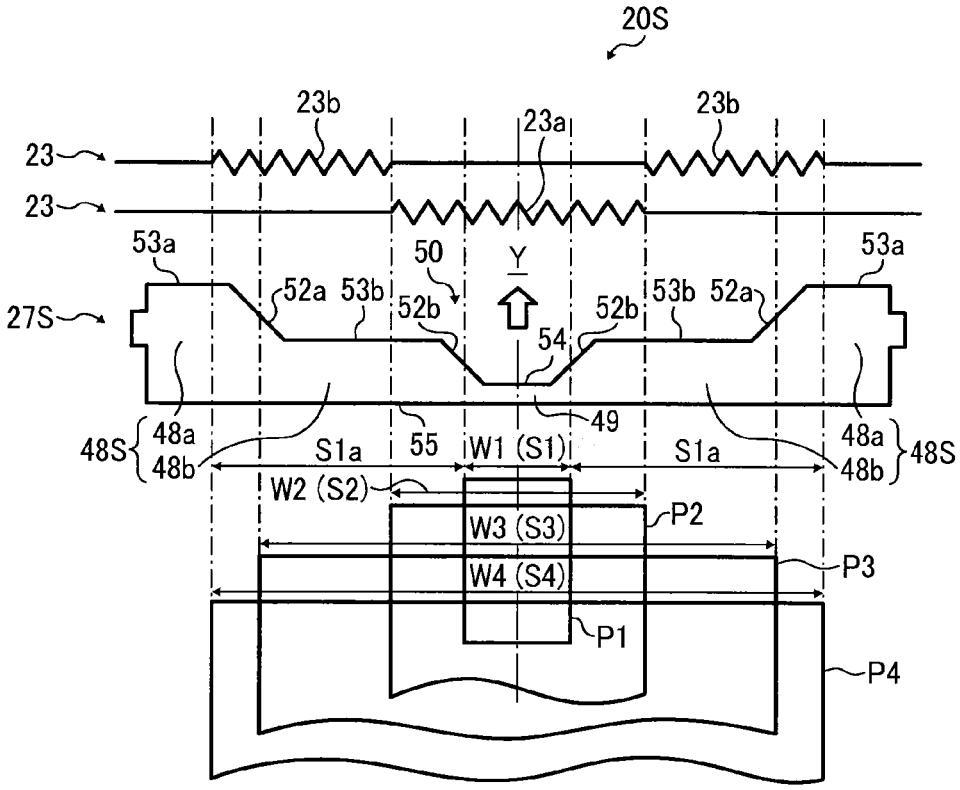
FIG. 12 is a schematic diagram of a fixing device according to another exemplary embodiment of the present invention.
Figure 13:
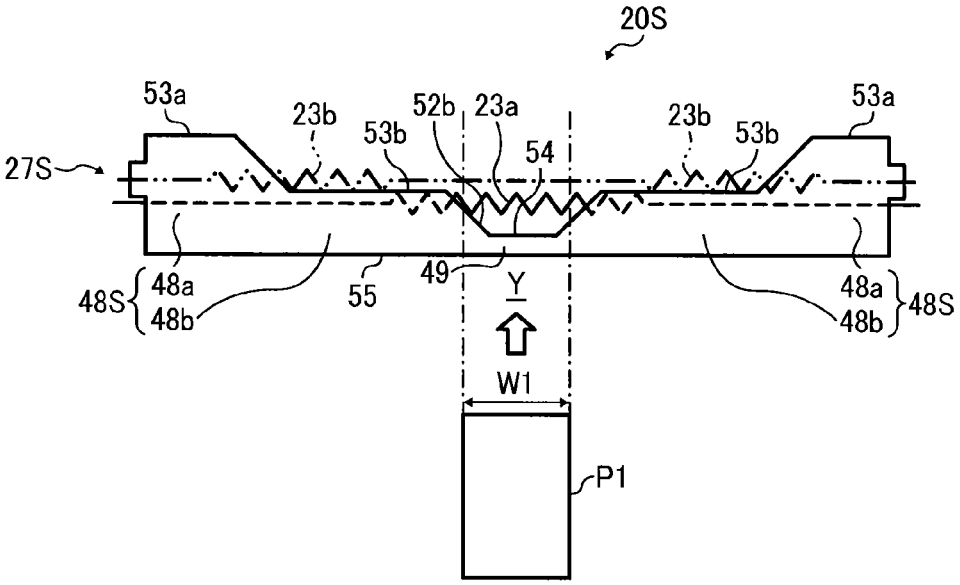
FIG. 13 is a partial schematic diagram of the fixing device shown in FIG. 12.

With reference to FIGS. 12 and 13, a description is provided of a configuration of a fixing device 20S incorporating a heat shield 27S according to another exemplary embodiment.

FIG. 12 is a schematic diagram of the fixing device 20S. FIG. 13 is a partial schematic diagram of the fixing device 20S. As shown in FIG. 12, the heat shield 27S includes a pair of shield portions 48S disposed at both lateral ends of the heat shield 27S in an axial direction thereof, respectively. Each of the shield portions 48S has two steps. Each shield portion 48S includes a first shield section 48*b* having an increased length in a longitudinal direction of the heat shield 27S parallel to the axial direction thereof and a second shield section 48*a* having a decreased length in the longitudinal direction of the heat shield 27S. The bridge 49 bridges the first shield section 48*b* of one shield portion 48S situated at one lateral end of the heat shield 27S and the first shield section 48*b* of another shield portion 48S situated at another lateral end of the heat shield 27S in the axial direction thereof. The second shield section 48*a* is contiguous to and outboard from the first shield section 48*b* in the axial direction of the heat shield 27S. An axially straight edge 53*a* situated at one end of the second shield section 48*a* in a circumferential direction of the heat shield 27S, that is, the rotation direction R3 of the fixing belt 21, is disposed downstream from an axially straight edge 53*b* situated at one end of the first shield section 48*b* in the circumferential direction of the heat shield 27S in the shield direction Y. The axially straight edge 53*b* is disposed downstream from the inner edge 54 of the bridge 49 in the shield direction Y. A sloped edge 52*a*, that is, an inboard edge of one second shield section 48*a* in the axial direction of the heat shield 27S is disposed opposite another sloped edge 52*a*, that is, an inboard edge of another second shield section 48*a* in the axial direction of the heat shield 27S. Similarly, a sloped edge 52*b*, that is, an inboard edge of one first shield section 48*b* in the axial direction of the heat shield 27S is disposed opposite another sloped edge 52*b*, that is, an inboard edge of another first shield section 48*b* in the axial direction of the heat shield 27S. That is, the sloped edges 52*a* and 52*b* constitute an inboard edge of the shield portion 48S in the axial direction of the heat shield 27S. The recess 50 between the pair of shield portions 48S in the axial direction of the heat shield 27S is defined and enclosed by the sloped edge 52*a* of each second shield section 48*a*, the axially straight edge 53*b* and the sloped edge 52*b* of each first shield section 48*b*, and the inner edge 54 of the bridge 49.

At least four sizes of recording media P including a small recording medium P1, a medium recording medium P2, a large recording medium P3, and an extra-large recording medium P4 are available in the fixing device 20S. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator 23*a* in the longitudinal direction of the halogen heater pair 23 parallel to the axial direction of the heat shield 27S. The sloped edge 52*b* of the first shield section 48*b* overlaps a side edge of the small recording medium P1. The sloped edge 52*a* of the second shield section 48*a* overlaps a side edge of the large recording medium P3. It is to be noted that a description of the relation between the position of recording media other than the small recording medium P1, that is, the medium recording medium P2, the large recording medium P3, and the extra-large recording medium P4, and the position of the center heat generator 23*a* and the lateral end heat generators 23*b* of the fixing device 20S is omitted because it is similar to that of the fixing device 20 described above.

As the small recording medium P1 is conveyed through the fixing nip N, the center heat generator 23*a* is turned on. However, since the center heat generator 23*a* heats the conveyance span S2 on the fixing belt 21 corresponding to the width W2 of the medium recording medium P2 that is greater than the width W1 of the small recording medium P1, the controller 90 moves the heat shield 27S to the shield position shown in FIG. 13. At the shield position, each first shield section 48*b* of the heat shield 27S shields the fixing belt 21 from the center heat generator 23*a* in an outboard span S1*a* outboard from a conveyance span S1 corresponding to the width W1 of the small recording medium P1 in the axial direction of the fixing belt 21. Accordingly, the fixing belt 21 does not overheat in each outboard span S1*a* where the small recording medium P1 is not conveyed over the fixing belt 21.

As the medium recording medium P2, the large recording medium P3, and the extra-large recording medium P4 are conveyed through the fixing nip N, the controller 90 performs a control for controlling the halogen heater pair 23 and the heat shield 27S that is similar to the control for controlling the halogen heater pair 23 and the heat shield 27 described above. In this case, each second shield section 48*a* of the heat shield 27S shields the fixing belt 21 from the halogen heater pair 23 as each shield portion 48 of the fixing device 20 does.

Like the shield portion 48 of the fixing device 20 that has the sloped edge 52, the second shield section 48*a* and the first shield section 48*b* have the sloped edges 52*a* and 52*b*, respectively. Accordingly, by changing the rotation angled position of the heat shield 27S, the controller 90 changes the span on the fixing belt 21 shielded from the center heat generator 23*a* and the lateral end heat generators 23*b* of the halogen heater pair 23 by the second shield section 48*a* and the first shield section 48*b* of each shield portion 48S.

The present invention is not limited to the details of the exemplary embodiments described above, and various modifications and improvements are possible. For example, the fixing belt 21 is used as a fixing rotary body. Alternatively, a hollow, tubular fixing roller, a solid fixing roller, a fixing film, or the like may be used as a fixing rotary body. The pressing roller 22 is used as an opposed body. Alternatively, a pressing belt, a pressing plate, a pressing pad, or the like may be used as an opposed body. Further, the shape of the heat shield is not limited to those of the heat shields 27 and 27S. For example, the heat shield may have three or more steps corresponding to the sizes of recording media available in the fixing device.

Further, when the heat shield 27 is at the retracted position shown in FIG. 4, a part of the heat shield 27 is disposed opposite the direct heating span DH on the fixing belt 21 and therefore heated by the halogen heater pair 23 directly. Alternatively, the entire heat shield 27 may be configured to be disposed opposite the indirect heating span IH on the fixing belt 21 by modifying the shape and the circumferential moving span of the heat shield 27 or the shape of the stay 25 and the reflector 26. In this case, the heat shield 27 at the retracted position is not heated by the halogen heater pair 23 and thereby is not subject to thermal deformation and wear.

With reference to FIGS. 2 to 4, 8, and 12, a description is provided of advantages of the fixing devices 20 and 20S described above.

The fixing devices 20 and 20S include a fixing rotary body (e.g., the fixing belt 21); a heater (e.g., the halogen heater pair 23) to heat the fixing rotary body; an opposed body (e.g., the pressing roller 22) contacting an outer circumferential surface of the fixing rotary body to form a nip (e.g., the fixing nip N) therebetween through which a recording medium is conveyed; a heat shield (e.g., the heat shields 27 and 27S) movably disposed opposite the heater to shield the fixing rotary body from the heater; a temperature detector (e.g., the temperature sensors 28*a* and 28*b*) to detect the temperature of the fixing rotary body or the opposed body; and a controller (e.g., the controller 90) to move the heat shield between a plurality of rotation angled positions. The heat shield includes a noncircular shield portion (e.g., the shield portions 48 and 48S) disposed opposite a lateral end of the fixing rotary body in an axial direction thereof to shield the fixing rotary body from the heater and a recess (e.g., the recess 50) contiguous to the shield portion. The shield portion is not circular in a circumferential direction of the fixing rotary body. The controller determines the rotation angled position of the heat shield based on the size of the recording medium and the temperature of the fixing rotary body or the opposed body detected by the temperature detector.

The controller determines the rotation angled position of the heat shield based on the size of the recording medium and the temperature of the fixing rotary body or the opposed body. Accordingly, even if the temperature of an outboard span (e.g., the outboard spans S1*a*, S2*a*, and S3*a*) of the fixing rotary body where the recording medium is not conveyed increases accidentally, the controller moves the heat shield to the rotation angled position where the heat shield shields the fixing rotary body from the heater in an increased span in the axial direction of the fixing rotary body based on the temperature of the fixing rotary body or the opposed body contacting the fixing rotary body. Consequently, the heat shield prevents overheating of the fixing rotary body in the outboard span where the recording medium is not conveyed.

According to the exemplary embodiments described above, the recording medium conveyed over the fixing belt 21 is centered in the axial direction thereof. Alternatively, the recording medium may be conveyed along one edge of the fixing belt 21 in the axial direction thereof. In this case, the heat shields 27 and 27S may include a single shield portion equivalent to the shield portion 48 or 48S that is disposed opposite one lateral end of the fixing belt 21 in the axial direction thereof.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a heater disposed opposite and heating the fixing rotary body using radiant heat;

an opposed body contacting the fixing rotary body to form a nip therebetween through which a recording medium is conveyed;

a heat shield movably disposed opposite the fixing rotary body to shield the radiant heat from the heater, the heat shield including:

a noncircular shield portion disposed opposite a lateral end of the fixing rotary body in an axial direction thereof to shield the fixing rotary body from the heater; and a recess defined by the shield portion in the axial direction of the fixing rotary body;

a temperature detector disposed opposite at least one of the fixing rotary body and the opposed body to detect a temperature of the at least one of the fixing rotary body and the opposed body; and a controller operatively connected to the heat shield and the temperature detector to determine a rotation angled position to which the heat shield is moved based on a size of the recording medium and the temperature of the at least one of the fixing rotary body and the opposed body detected by the temperature detector.

2. The fixing device according to claim 1, wherein the controller selects one rotation angled position to which the heat shield is moved from among a plurality of candidate rotation angled positions preset according to the size of the recording medium based on the temperature of the at least one of the fixing rotary body and the opposed body detected by the temperature detector.

3. The fixing device according to claim 2, wherein the plurality of candidate rotation angled positions includes a shield position where the shield portion of the heat shield is interposed between the heater and the fixing rotary body and a retracted position where the shield portion of the heat shield is not interposed between the heater and the fixing rotary body.

4. The fixing device according to claim 1, wherein the controller determines the rotation angled position to which the heat shield is moved based on an elapsed conveyance time elapsed after the recording medium enters the nip as determined by the controller.

5. The fixing device according to claim 1, wherein the controller determines the rotation angled position to which the heat shield is moved based on a number of recording media conveyed through the nip as counted by the controller.

6. The fixing device according to claim 1, wherein the shield portion of the heat shield includes a first sloped edge situated at one end of the shield portion in the axial direction of the fixing rotary body and angled relative to a circumferential direction of the fixing rotary body.

7. The fixing device according to claim 6, wherein the first sloped edge of the shield portion of the heat shield overlaps a side edge of the recording medium in the axial direction of the fixing rotary body as the recording medium is conveyed over the fixing rotary body.

8. The fixing device according to claim 7, wherein the recording medium is a standard size sheet.

9. The fixing device according to claim 1, wherein the shield portion of the heat shield includes a first, axially straight edge situated at one end of the shield portion in a circumferential direction of the fixing rotary body and extending in the axial direction of the fixing rotary body.

10. The fixing device according to claim 9, wherein the shield portion of the heat shield further includes a first sloped edge contiguous to and angled relative to the first, axially straight edge.

11. The fixing device according to claim 10, wherein the shield portion of the heat shield further includes a circumferentially straight edge contiguous to the first sloped edge and extending in the circumferential direction of the fixing rotary body.

12. The fixing device according to claim 11, wherein the recess includes an inner edge contiguous to the circumferentially straight edge of the shield portion of the heat shield and extending in the axial direction of the fixing rotary body.

13. The fixing device according to claim 10, wherein the recess includes an inner edge contiguous to the first sloped edge of the shield portion of the heat shield and extending in the axial direction of the fixing rotary body, and wherein the shield portion of the heat shield further includes:

a second sloped edge contiguous to and outboard from the first, axially straight edge in the axial direction of the fixing rotary body; and a second, axially straight edge contiguous to and outboard from the second sloped edge in the axial direction of the fixing rotary body.

14. The fixing device according to claim 13, wherein the heater includes:

a center heat generator disposed opposite a center of the fixing rotary body in the axial direction thereof; and a lateral end heat generator disposed opposite the lateral end of the fixing rotary body in the axial direction thereof, and wherein the first sloped edge of the shield portion of the heat shield is disposed opposite the center heat generator and overlaps a side edge of the recording medium of a decreased size and the second sloped edge of the shield portion of the heat shield is disposed opposite the lateral end heat generator and overlaps a side edge of the recording medium of an increased size.

15. The fixing device according to claim 10, wherein the heater includes:

a center heat generator disposed opposite a center of the fixing rotary body in the axial direction thereof; and a lateral end heat generator disposed opposite the lateral end of the fixing rotary body in the axial direction thereof, and wherein the first sloped edge of the shield portion of the heat shield is disposed opposite the lateral end heat generator.

16. The fixing device according to claim 1, further comprising a nip formation assembly pressing against the opposed body via the fixing rotary body to form the nip between the fixing rotary body and the opposed body, wherein the fixing rotary body includes an endless fixing belt.

17. An image forming apparatus comprising the fixing device according to claim 1.

18. The fixing device according to claim 1, further comprising:

a motor connected to the controller.

19. The fixing device according to claim 18, wherein:

the motor is connected to the heat shield to move the heat shield to the rotation angled position.

20. The fixing device according to claim 1, further comprising:

a motor connected to the controller and the heat shield, wherein:

the controller is operatively connected to the heat shield through the motor, and the motor moves the heat shield to the rotation angled position.

21. A fixing method comprising:

placing a heat shield at a retracted position where the heat shield is not interposed between a heater which generates radiant heat and a fixing rotary body, the heat shield movably disposed opposite the fixing rotary body, the heat shield including:

a noncircular shield portion disposed opposite a lateral end of the fixing rotary body in an axial direction thereof to shield the fixing rotary body from the radiant heat from the heater; and a recess defined by the shield portion in the axial direction of the fixing rotary body, conveying a recording medium over the fixing rotary body;

determining a temperature of the fixing rotary body;

moving the heat shield to a first rotation angled position where the heat shield is interposed between the heater and the fixing rotary body to shield the fixing rotary body from the heater, depending on the temperature which has been determined; and moving the heat shield to a second rotation angled position where the heat shield is interposed between the heater and the fixing rotary body to shield the fixing rotary body more fully from the heater than at the first rotation angled position, depending on the temperature that has been determined.

22. The fixing method according to claim 21, further comprising:

moving the heat shield to the first rotation angled position when a predetermined first conveyance time elapses after the recording medium comes into contact with the fixing rotary body; and moving the heat shield to the second rotation angled position when a predetermined second conveyance time greater than the first conveyance time elapses after the recording medium comes into contact with the fixing rotary body.

23. The fixing method according to claim 21, wherein:

said determining determines the temperature of the fixing rotary body is not lower than a predetermined first temperature, and said moving of the heat shield to the first rotation angled position where the heat shield is interposed between the heater and the fixing rotary body to shield the fixing rotary body from the heater is performed, when said determining determines that the temperature of the fixing rotary body is not lower than the predetermined first temperature, the fixing method further comprising:

determining that the temperature of the fixing rotary body is not lower than a predetermined second temperature higher than the first temperature, wherein:

the moving of the heat shield to the second rotation angled position moves the heat shield to the second rotation angled position when it is determined that the temperature of the fixing rotary body is not lower than the predetermined second temperature which is higher than the first temperature.

* * * * *